US009676224B2

(12) United States Patent
Gardner

(10) Patent No.: US 9,676,224 B2
(45) Date of Patent: Jun. 13, 2017

(54) MODULAR MAGNET WRITING INSTRUMENT AND HOBBY TOOL

(71) Applicant: Andrew Gardner, Waterloo (CA)

(72) Inventor: Andrew Gardner, Waterloo (CA)

(73) Assignee: IndieDesign Ltd., Waterloo, Ontario ( * ) Notice: Subject to any disclaimer, the term of this patent is extended or adjusted under 35 U.S.C. 154(b) by 0 days.

(21) Appl. No.: 14/338,156

(22) Filed: Jul. 22, 2014

(65) Prior Publication Data

US 2015/0023718 A1 Jan. 22, 2015

(30) Foreign Application Priority Data

Jul. 22, 2013 (GB) ..... 1313045.5

(51) Int. Cl.

| | |
|---|---|
| ***B43K 29/00*** | (2006.01) |
| ***B43K 8/00*** | (2006.01) |
| ***B43K 21/00*** | (2006.01) |
| ***B43K 5/00*** | (2006.01) |
| ***B43K 7/00*** | (2006.01) |

(52) U.S. Cl.

CPC ..... *B43K 29/00* (2013.01); *B43K 5/005* (2013.01); *B43K 7/005* (2013.01); *B43K 8/003* (2013.01); *B43K 21/006* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,505,553 | A * | 4/1996 | Saviano | B43K 29/00 401/100 |
| 5,788,232 | A * | 8/1998 | Binkley | A63F 9/0811 273/153 S |
| 6,612,766 | B2 * | 9/2003 | Collins | B43K 7/005 401/195 |
| 7,780,499 | B1 * | 8/2010 | Truckai | A63H 33/088 401/195 |
| 2007/0059089 | A1 * | 3/2007 | Junkins | B43K 5/005 401/195 |
| 2009/0297250 | A1 * | 12/2009 | Huang | B43K 5/005 401/243 |

* cited by examiner

*Primary Examiner* — David Walczak

(57) ABSTRACT

A modular magnet writing instrument and hobby tool comprises a plurality of permanent magnet segments and a writing cartridge. Each magnet segment is magnetized axially. An aperture extends longitudinally through the entirety of each magnet segment. The writing cartridge has an elongate body, which is sized for coaxial insertion within a magnet segment, or plurality of magnet segments, such that the magnet segments are in sliding engagement with the elongate body. In operation, different combinations of magnet segments can be axially positioned on the elongate body, in a variety of like-pole and unlike-pole interactions, to produce a plurality of writing and hobby tool configurations.

16 Claims, 12 Drawing Sheets

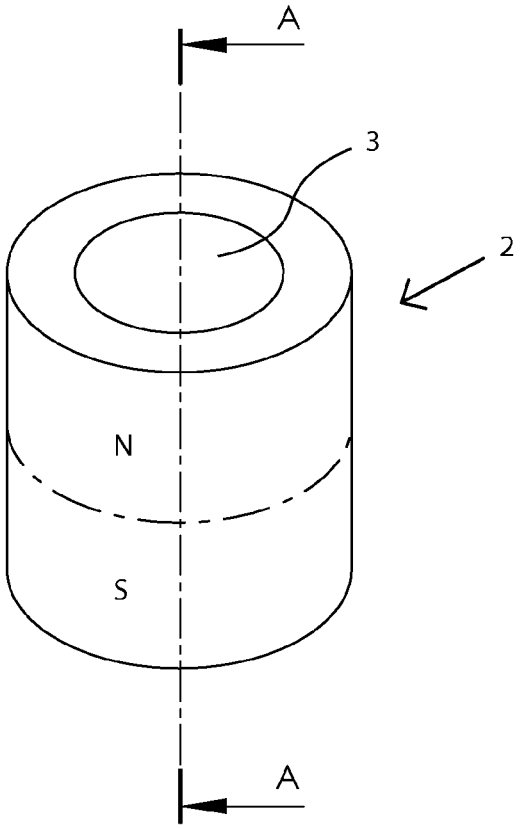
FIG. 2 A
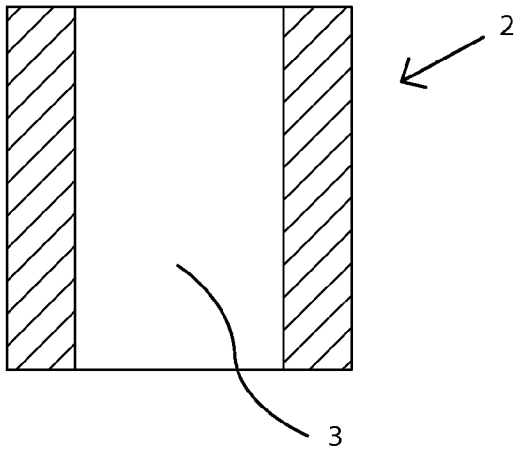
FIG. 2 B

MODULAR MAGNET WRITING INSTRUMENT AND HOBBY TOOL

CROSS REFERENCE

This application claims the benefit of Application No. 1313045.5 filed in the Intellectual Property Office of the United Kingdom on Jul. 22, 2013.

BACKGROUND

Magnets are primarily used in writing instruments, including pens, for the purpose of facilitating the attachment of such writing instruments to other magnetized products, including refrigerators and blackboards. Magnets may also be incorporated into writing devices to facilitate the picking up of small metallic parts around the workplace. Magnets can also be employed to secure caps on writing instruments.

What is desired is combination magnet writing instrument and hobby tool, which can be arranged into a wide range of configurations for supporting a variety of uses, including those described in the paragraph above, as well as pure hobbyist or leisure activities, which activities may be undertaken as a form of brainstorming or stress relief. In this regard, it is believed that even short time periods of leisure time in the course of a working day will serve to enhance a worker's overall productivity. In addition, it is believed that short time periods of leisure time during the working day, will have beneficial impacts on a worker's physical and emotional health.

SUMMARY OF THE INVENTION

In one embodiment of the present invention, there is provided a modular magnet writing instrument and hobby tool comprising a plurality of permanent magnet segments, each magnet segment having an aperture extending longitudinally therethrough and magnetized axially, wherein the plurality of permanent magnet segments are disposed end-to-end to form a magnet housing, and a writing cartridge releasably attached to an end of the magnet housing, the writing cartridge comprising a writing member and an elongate body, wherein the outside diameter of the elongate body is sized to fit substantially within the magnet housing to produce a writing instrument arrangement.

In another embodiment of the present invention, there is provided, a modular magnet writing instrument and hobby tool comprising a plurality of permanent magnet segments, each magnet segment having an aperture extending longitudinally therethrough and magnetized axially, and a writing cartridge having an elongate body, wherein the outside diameter of the elongate body is of a size smaller than the inside diameter of each of the plurality of magnet segments, wherein certain (meaning any number) of the plurality of magnet segments are removably attached to each other and certain of the plurality of magnet segments are positioned axially around the elongate body in a plurality of configurations, to form a plurality of hobby tool arrangements.

In yet another embodiment of the present invention, there is provided a kit of parts for forming a combination writing instrument and hobby tool, the kit of parts comprising a plurality of permanent magnet segments, each magnet segment having an aperture extending longitudinally therethrough and magnetized axially, and a writing cartridge having an elongate body, wherein the outside diameter of the elongate body is of a size smaller than the inside diameter of each of the plurality of magnet segments, wherein certain of the plurality of magnet segments can be removably attached to each other and certain of the plurality of magnet segments can be positioned axially around the elongate body in a plurality of configurations, to form a plurality of hobby tool arrangements.

The foregoing embodiment of the present invention, and other embodiments, will become more fully apparent from a review of the description and claims which follow.

BRIEF DESCRIPTION OF THE DRAWINGS

FIG. 2A is a perspective view of a permanent magnet segment in accordance with an embodiment of the present invention.

FIG. 2B is a cross-sectional view of the permanent magnet segment of FIG. 2A through the line A-A.

DETAILED DESCRIPTION

Figure 1:
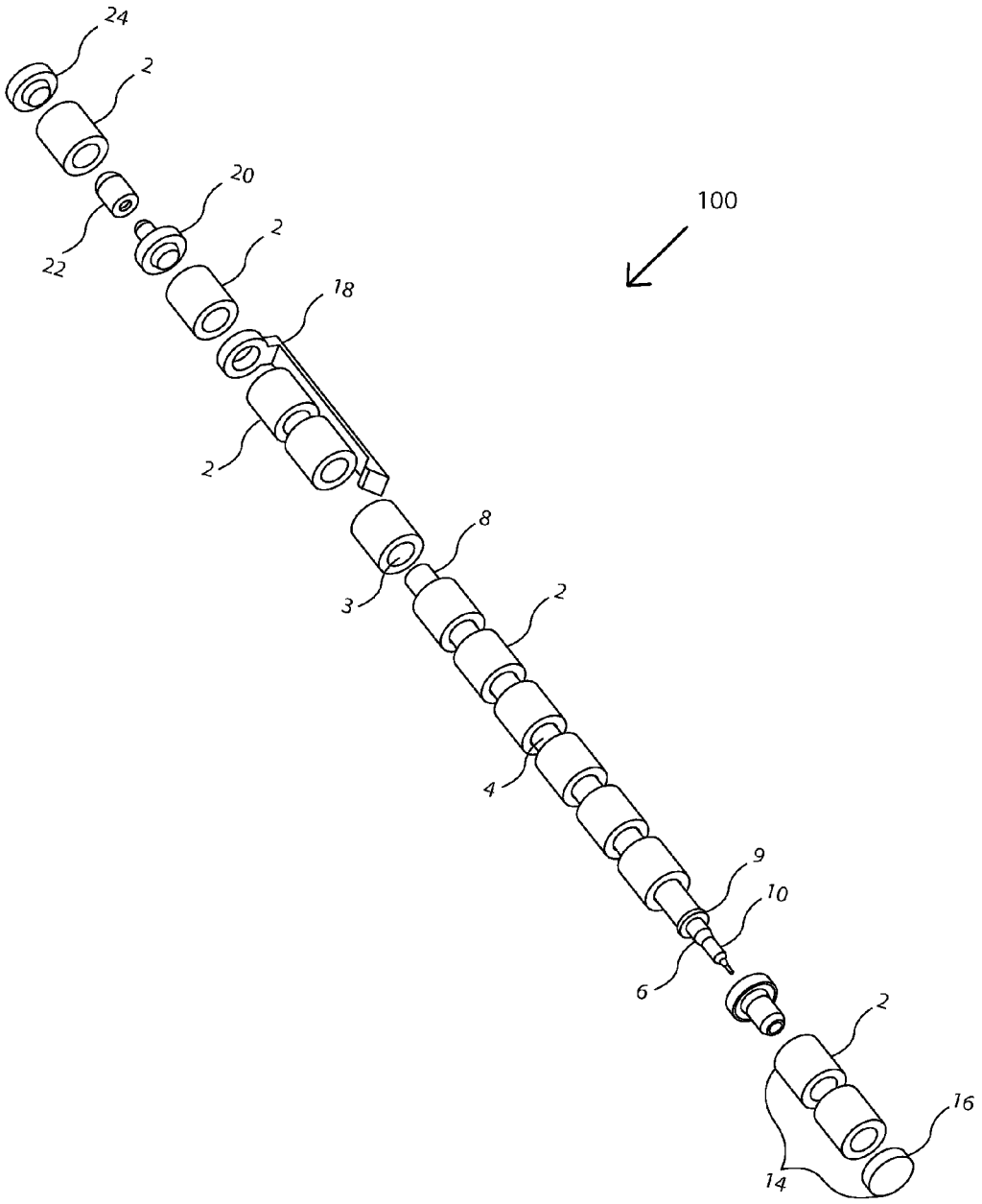
FIG. 1 is a partial exploded view of a modular magnet tool in accordance with an embodiment of the present invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 3:
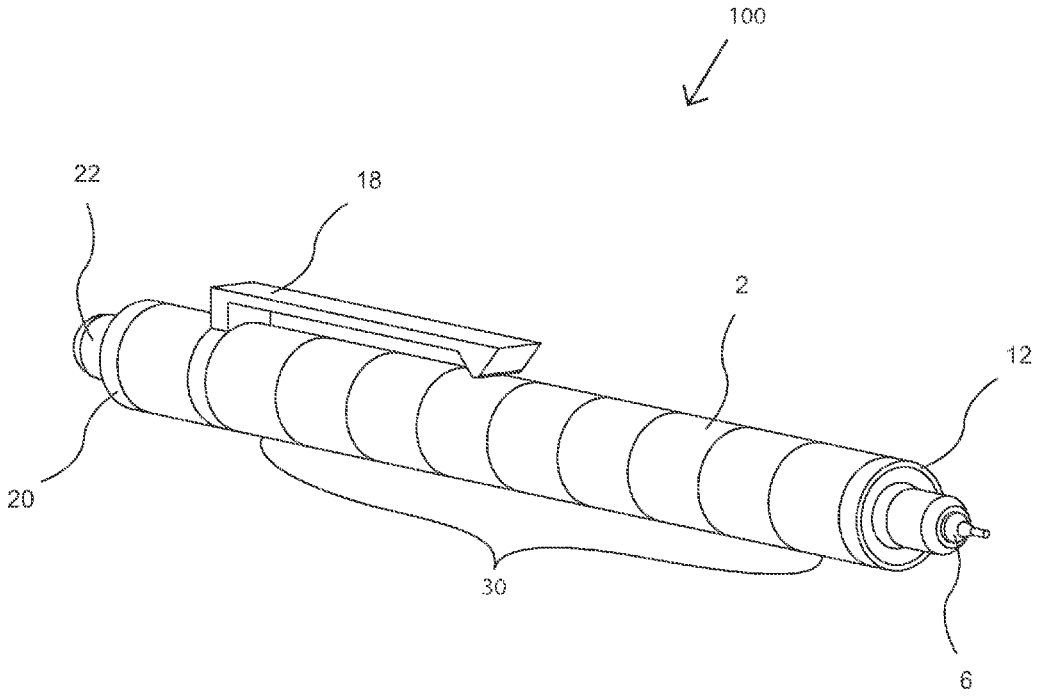
FIG. 3 is a perspective view of a modular magnet tool in accordance with an embodiment of the present invention.
Figure 4:
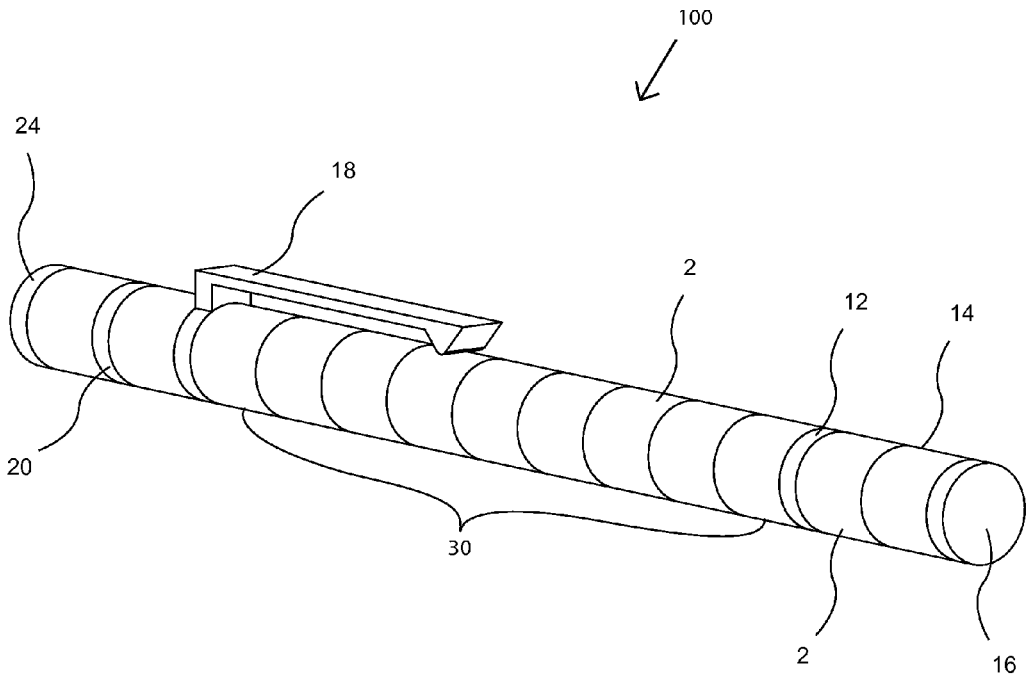
FIG. 4 is a perspective view of an alternate embodiment of the modular magnet tool of the present invention.

Referring to the drawings, and initially to FIG. 1, there is shown a partial exploded view of a modular magnet writing instrument and hobby tool 100 (also herein described as a modular magnet tool, or simply, tool) in accordance with one aspect of the present invention. The tool 100 is provided with a plurality of magnet segments 2. Each magnet segment 2 is comprised of a material that is magnetized and creates its own persistent magnetic field. In this way, each magnet segment 2 is a permanent magnet having a magnetic north pole and a magnetic south pole, creating a magnetic north pole field and a magnetic south pole field, respectively. Each magnet segment 2 is provided with an aperture 3 which aperture 3 extends longitudinally from a first end of each magnet segment 2 to a second end thereof. A single magnet segment 2 is illustrated in FIGS. 2A and 2B, where FIG. 2B shows a vertical cross-section of the magnet segment of FIG. 2A, taken through the line A-A. Each magnet segment 2 is magnetized axially, such that a plurality of magnet segments 2 can be positioned end-to-end with North and South poles oriented for attraction of corresponding magnets, to form a magnet housing (not shown). The magnet housing is depicted in FIGS. 3 and 4 by reference numeral 30. The north and south poles of an individual magnet segment 2 are shown generally in FIG. 2A by the markings N and S, respectively.

Figure 6A:
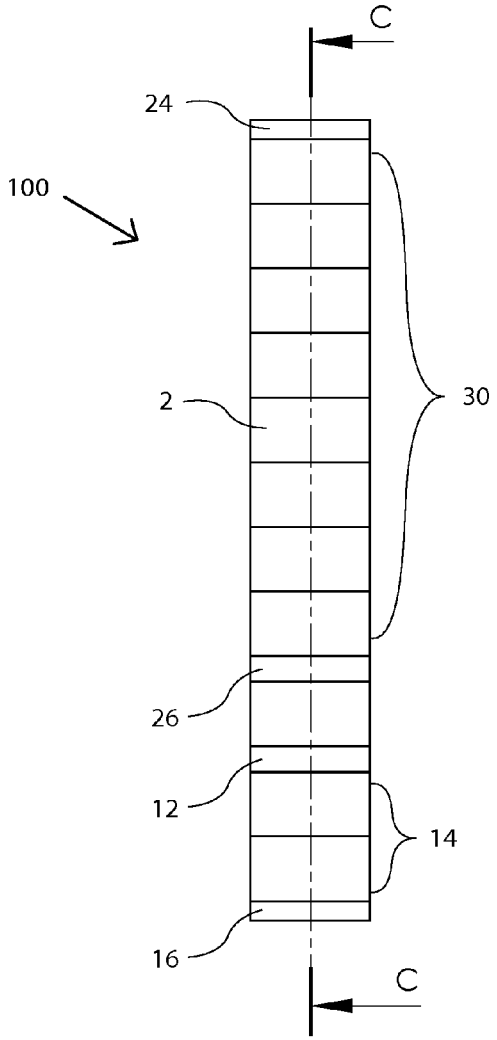
FIG. 6A is a side view of an alternate embodiment of the modular magnet tool of the present invention.
Figure 6B:
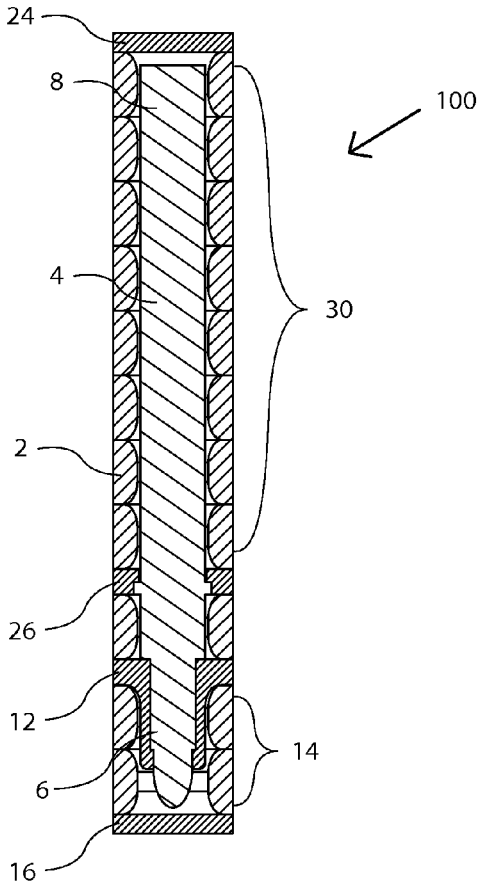
FIG. 6B is a cross-sectional view of the modular magnet tool of FIG. 6A through the line C-C.

While each of the plurality of magnet segments 2 can be uniform in shape and/or size, one of skill in the art will appreciate that magnet segments 2 in any combination of shape and size may be employed. In the embodiment shown in FIG. 1, the magnet segments 2 are of uniform shape and size, and each magnet segment 2 is substantially cylindrically shaped and each aperture 3 is substantially circular. Of course, the magnet segments 2 could take on a range of different shapes (e.g. the magnet segments could be flat sided, hexagonal, square-shaped, or have large external and/or internal radiuses as depicted in the embodiment of FIGS. 6A and 6B).

Still referring to FIG. 1, the tool 100 further includes a writing cartridge, shown generally by reference numeral 4. The writing cartridge 4 includes a writing member 6 and an elongate body 8, wherein the elongate body 8 depends from the writing member 6, and further wherein the elongate body 8 is sized to fit substantially within the magnet housing 30. Accordingly, the outside diameter of the elongate body 8 is of a size smaller than the inside diameter of the magnet housing 30, wherein the inside diameter of the magnet housing 30 is dictated by apertures 3 of each magnet segment 2. In this way, the elongate body 8 is sized for coaxial insertion within the magnet housing 30, and, as applicable, within a given magnet segment 2. When the magnet segments 2 are aligned end-to-end with north and south poles oriented for attraction, a channel is formed to accommodate the elongate body 8 of the writing cartridge 4. In the embodiment shown in the drawings, the channel formed by alignment of magnet segments 2 is annular in shape.

In order to accommodate a wide range of tool configurations, it is preferred that the outer walls of the elongate body 8 are sized for sliding engagement with the inner walls of each magnet segment 2 in a coaxial arrangement. Optionally, the outer surface of the elongate body 8 is composed of a low friction material, for facilitating sliding of magnet segments 2 about the elongate body 8. In any case, the elongate body 8, or a portion thereof, must be capable of passing through (or into) the magnet housing 30 channel. In the embodiment shown in the drawings, both the magnet segments 2 and the elongate body 8 are substantially cylindrically shaped, such that a single continuous wall forms the outer wall of the elongate body 8, and a single continuous wall forms the inner wall of each magnet segment. Optionally, the elongate body 8 of the writing cartridge 4 includes a writing fluid receptacle, for housing a quantity of writing fluid. In FIG. 1, it can be seen how the magnet segments 2 slide over the elongate body 8 of the writing cartridge 4.

The writing member 6 can take many forms. For example, the writing member 6 could take the form of a pen, pencil, marker, crayon, pencil-crayon, stylus, or the like. In one embodiment, the writing member 6 includes a writing tip assembly 10 at a first end of the writing member 6. The writing cartridge 4 itself may take the form of a pen refill, marker insert, mechanical pencil insert, or the like. Components of the tool 100 can be modified and or scaled to enable the tool 100 to hold different forms of writing inserts.

In order to form a writing instrument (to support a writing and/or drawing utility) using the magnet segments and writing cartridge, a plurality of magnet segments 2 can be positioned end-to-end with north and south poles oriented for attraction of corresponding magnets, to form a magnet housing 30, and the elongate body 8 of the writing cartridge 4 can be positioned into the channel formed by the magnet housing 30, such that the elongate body 8 is substantially contained within the magnet housing 30 channel and the writing member 6 protrudes beyond the magnet housing 30, and wherein the magnet segments 2 comprising the magnet housing 30 are axially positioned around the elongate body 8. In order to prevent the writing cartridge 4 from sliding completely through the magnet housing 30, the writing member 6 may be equipped with a flange portion 9 for overlapping (or partially overlapping) with an end of the magnet housing 30.

In order to accommodate use of the tool 100 for both writing and hobbyist (or leisure) pursuits, it is imperative that the writing cartridge 4 be releasably secured to the magnet housing 30, such that the writing cartridge 4 can be readily detached from the magnet housing 30 in order to accommodate other uses of the tool 100. Accordingly, a writing cartridge securement member 12 may be employed for releasably connecting the writing cartridge 4 to the magnet housing 30. In one embodiment, the writing cartridge securement member 12 takes the form of a collar which is sized to fit around the writing member 6, and if equipped, the writing tip 10, and contact the magnet housing 30. In the embodiment shown in FIG. 1, the writing cartridge securement member 12 is composed of a ferromagnetic material which holds the writing cartridge 4 in contact with the magnet housing 30 by magnetic force. In another embodiment, the writing cartridge 4, or a portion thereof, may itself be composed of a ferromagnetic material, thereby obviating the need for a writing cartridge securement member 12 as a separate component. Consider, for example, that the flange portion 9 of the writing member 6 (or other portion, or portions, of the writing member 6) may itself be magnetized. In this example, the magnetized flange portion 9 functions as the writing cartridge securement member 12. Further, optionally, the writing member 6 itself can be magnetized, in which case the writing member 6 functions as the writing cartridge securement member 12 for releasably securing the writing cartridge 4 to the magnet housing 30.

As discussed herein, the magnet segment 2 depicted in FIG. 2A is a permanent magnet magnetized axially, and having a north pole represented by the letter N and a south pole represented by the letter S. In one embodiment, each magnet segment is composed of an N35 grade magnet, but weaker or stronger magnets could be used. In one embodiment, the maximum outer dimensions of each magnet segment 2 are a diameter of 20 mm diameter and a height of 25 mm, whereas the minimum outer dimensions of each magnet segment 2 are a diameter of 7 mm and a height of 3 mm.

Still referring to FIG. 1, it can be seen that additional optional components may be incorporated into the writing instrument assembly depicted in FIG. 1. For example, additional magnet segments 2 and ferromagnetic components can be combined to add functionality to the writing instrument. Each ferromagnetic component may be fully or partially magnetized, or not magnetized at all. In addition, each ferromagnetic component may be comprised of both ferromagnetic and non-ferromagnetic elements. For example, each ferromagnetic component may itself be a permanent magnet or may be composed of a ferrous metal or, alternatively, contain a ferrous metal as one component thereof. Ferromagnetic substances which could be employed include, but are not limited to iron, nickel, cobalt, and alloys of each of the foregoing, and compounds of rare earth metals. In the embodiment shown in FIG. 1, ferromagnetic components, such as a writing instrument cap 14 may be formed by an at least one magnet segment 2 and a lid portion 16. The cap 14 serves to protect the writing member 6, or otherwise prevent the writing member 6 from drying or leaking, when not in use. The lid portion 16 may include silicone as a constituent, such that the writing member 6 nests into the silicone-based lid portion 16 to prevent the writing member 6 from drying out.

Additionally, a ferromagnetic clip portion 18 may be incorporated into the magnet housing 30, by releasable securement between individual magnet segments 2, as illustrated in FIG. 3 and FIG. 4. Additional ferromagnetic components may include a stylus or multi-component stylus 20, 22 (including a connectable ferromagnetic platform 20 and rubber stylus tip 22 for positioning on top of such ferromagnetic platform 20), and an end cap 24 for positioning on a distal end of the magnet housing 30, wherein the stylus tip 22 is used for writing on touch screen devices. The ferromagnetic platform 20 that receives the stylus tip 22 can also accommodate other tips, including but not limited to an eraser or compass point. Referring to FIG. 3 and FIG. 4, the tool 100 is shown in a writing instrument configuration with and without the optional cap 14. In the configurations shown in FIGS. 3 and 4, the tool 100 is held together by the magnetic fields produced by the permanent magnets, which comprise each magnet segment 2, without need for glue, threads or compression fittings. In this way, the tool 100 (shown in FIGS. 3 and 4) can be readily disassembled into its individual components, and thereafter readily reassembled into other useful configurations, including configurations for supporting hobbyist pursuits of a user, as described herein.

Still referring to FIGS. 3 and 4, when the optional clip portion 18 is pulled outward from the magnet housing 30, it will dislodge from the bottom magnet of the magnet housing 30, to enable a user to access the magnet segments 2 of the magnet housing and readily disassemble the tool 100 from its writing configuration. All modular components of the within invention are designed for simple assembly and replacement.

Figure 5A:
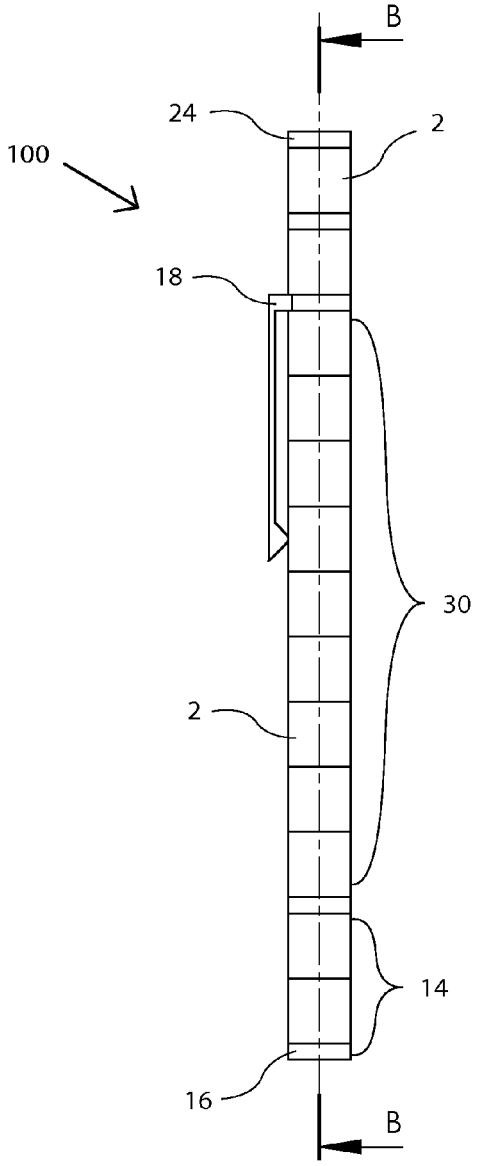
FIG. 5A is side view of the modular magnet tool of FIG. 4.
Figure 5B:
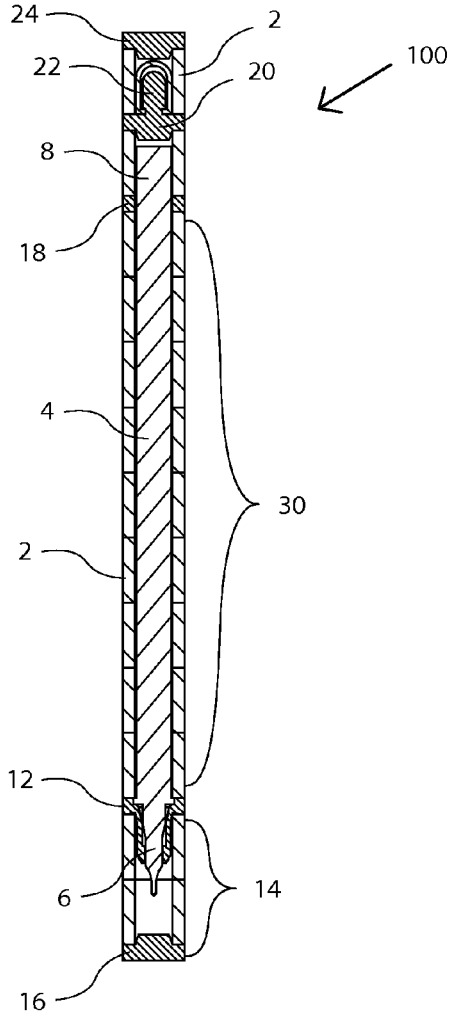
FIG. 5B is a cross-sectional view of the modular magnet tool of FIG. 5A through the line B-B.

FIGS. 5A and 5B illustrate the tool 100 in a writing instrument configuration, wherein FIG. 5B shows a cross-section of the writing instrument configuration of the tool of FIG. 5A, taken through the line B-B. The writing member 6 depicted in FIGS. 5A and 5B is a pen. The cross-sectional view of the tool 100 depicted in FIG. 5B duly illustrates the modular nature of the tool 100, in order to support a wide variety of different possible implementation configurations, for example, for writing or pure hobbyist purposes. FIGS. 6A and 6B illustrate the tool 100 in an alternate writing instrument configuration, wherein FIG. 6B shows a cross-section of the writing instrument configuration of the tool of FIG. 6A, taken through the line C-C, and wherein the writing member 6 depicted is a marker style insert. In the FIG. 6A and 6B embodiments, a ferromagnetic securement collar 26 is shown. This collar 26 is adapted for interconnecting with a flange portion of the writing cartridge 4 (in this case, a marker cartridge) to hold the writing cartridge 4 in position within the magnet housing 30.

Figure 7:
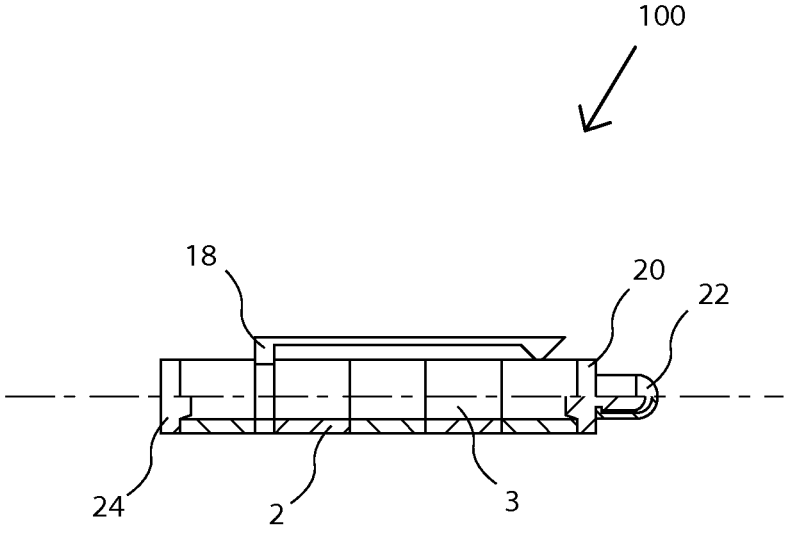
FIG. 7 is a partial cross-section illustration of an alternate embodiment of the modular magnet tool of the present invention.

Referring next to FIG. 7, there is shown a partial cross-sectional view of another embodiment of the tool 100 in a writing configuration, wherein the multi-component stylus 20, 22 is assembled in place of the writing cartridge (not shown).

Figure 8:
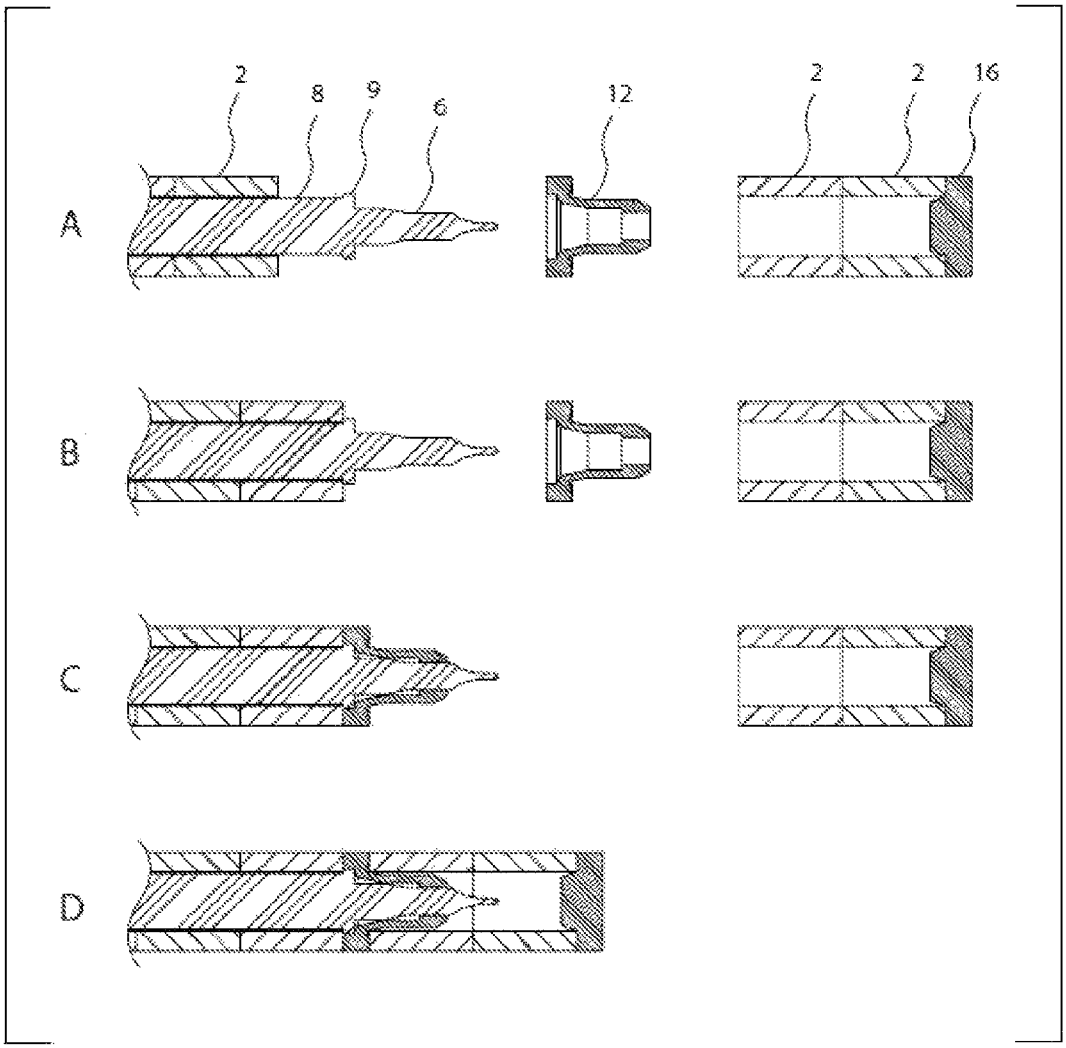
FIG. 8 depicts four cross sectional drawings of a portion of the modular magnet tool of the present invention in sequence illustrating how the writing cartridge can be secured to the magnet housing and how the cap can be utilized.

FIG. 8 shows a cross-section series of drawings illustrating how the elongate body 8 is inserted into the magnet housing (partially shown), and how the cap is formed of an at least one magnet segment 2 and lid 16. In the embodiment shown in FIG. 8, the writing member 6 is shown protruding through the magnet housing, when the elongate body 8 is positioned inside the magnet housing channel. The writing member 6 itself cannot slide through the magnet housing channel by operation of the flange portion 9, or alternatively, detachable attachment of the writing member 6 within the writing cartridge securement member 12 (for example, by snug fitting of the writing member 6 to the writing cartridge securement member 12). In the embodiment depicted in FIG. 8, it can be seen that the internal dimension of the magnet segments 2 of the magnet housing must be large enough for the elongate body 8 of the writing cartridge to slide into the magnet housing channel and small enough so that the flange portion 9 of the writing member 6 cannot fit through the magnet housing channel. In FIG. 8, the writing cartridge securement member 12 is ferromagnetic and is held in position by the magnetic field created by the magnet segments 2 of the magnet housing.

Figure 10:
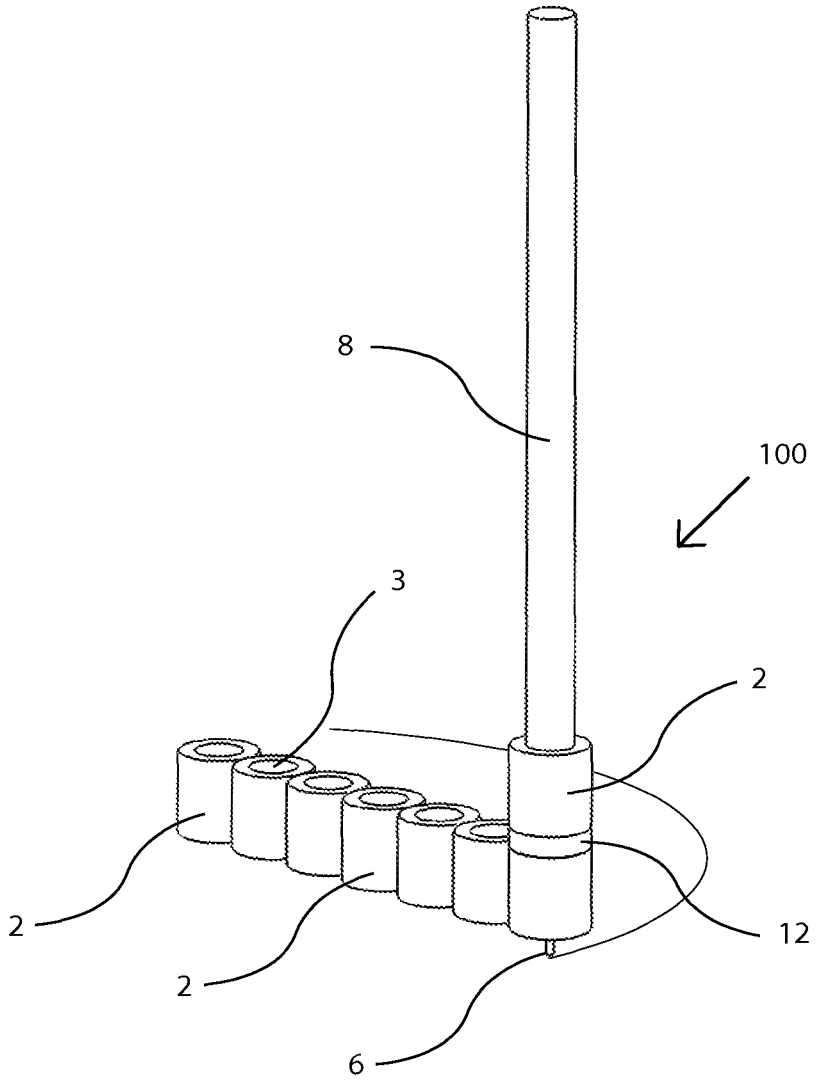
FIG. 10 is a perspective view of an alternate embodiment of the present invention used as a writing compass.

The magnet segments 2 inherently align themselves when disposed in close proximity to each other, needing no assistance from internal or external components. As discussed herein, the magnet segments 2 can be stacked longitudinally to create the embodiment of FIG. 3, but can also be positioned latitudinally with alternating North and South poles to produce a writing compass arrangement, as depicted in FIG. 10, for drawing circles using the writing member 6 of the tool 100. By alternating the magnet segment 2 poles, North to South on their sides, the magnet segments 2 are held together by magnetic forces. In operation, a user can apply force to the center magnet segment 2 which is distally positioned from the elongate body 8 and writing member 6, and rotate the elongate body 8 about its horizontal axis to draw a perfect circle on a page. Different sized circles can be drawn depending on the number of magnet segments 2 added to the latitudinal chain.

Figure 9:
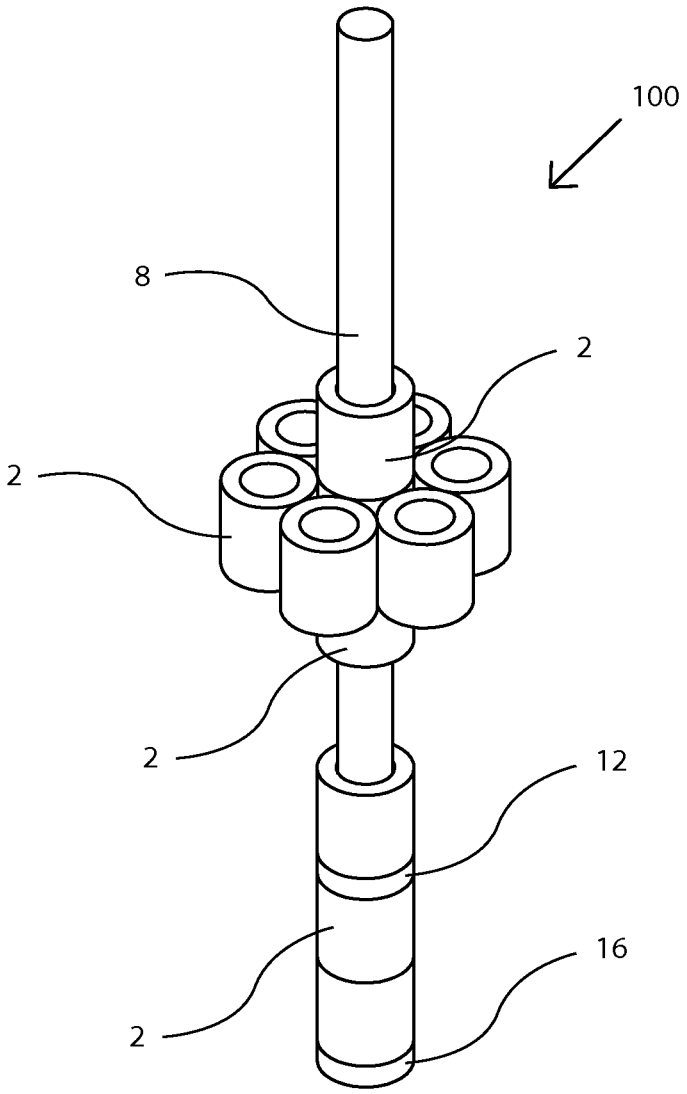
FIG. 9 is a perspective view of an embodiment of the present invention used for a hobby pursuit.

Individual magnet segments 2 can also be arranged in a like-pole arrangement (e.g. North facing North or South facing South), such that the magnet segments 2 positioned in this way will repel each other. In FIG. 9, magnet segments 2 have been positioned together in an arrangement that uniquely exploits the magnetic fields of each magnet segment 2 to both hold components together, while repelling other components to produce a spinning top arrangement.

In the embodiment shown in FIG. 9, a plurality of magnet segments 2 are positioned through the elongate body 8 of the writing cartridge 4 to form a type of spinning element (or spinning top). The elongate body 8 is placed vertically on a flat surface (such as a table top) and stabilized by the weight of magnet segments 2 positioned proximate from the open end of the elongate body 8. The flat lid 16 supports the tool 100 on such surface. By arranging at least the lower-most positioned magnet segment 2 of the spinning element in a like-pole arrangement with at least the upper-most positioned magnet segment 2 of the proximately positioned magnet segments 2, and using the elongate body 8 as a guide or axle, the spinning element repels itself from the proximately positioned magnets and can be spun freely around the elongate body 8 with minimal resistance upon the application of a minimum horizontal force to the spinning element.

Figure 11:
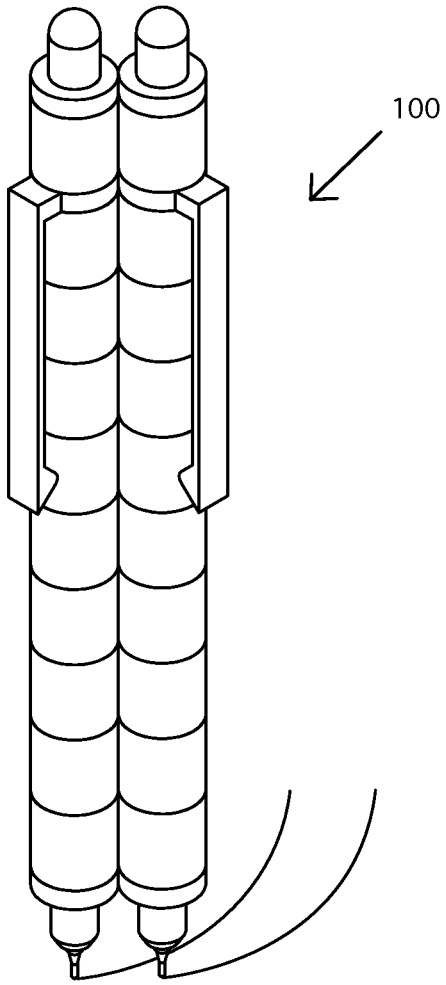
FIG. 11 is a perspective view of two modular magnet tools of the present invention held together by their magnetic forces and used to draw multiple lines simultaneously.

FIG. 11 illustrates how two tools 100 in a writing instrument configuration can be releasably secured together by their magnetic forces to enable a user to draw two equally spaced lines simultaneously. In order to secure two such tools 100 together, magnet segments 2 can be aligned from North to South on one tool 100 and from South to North on the other tool 100.

Figure 12:
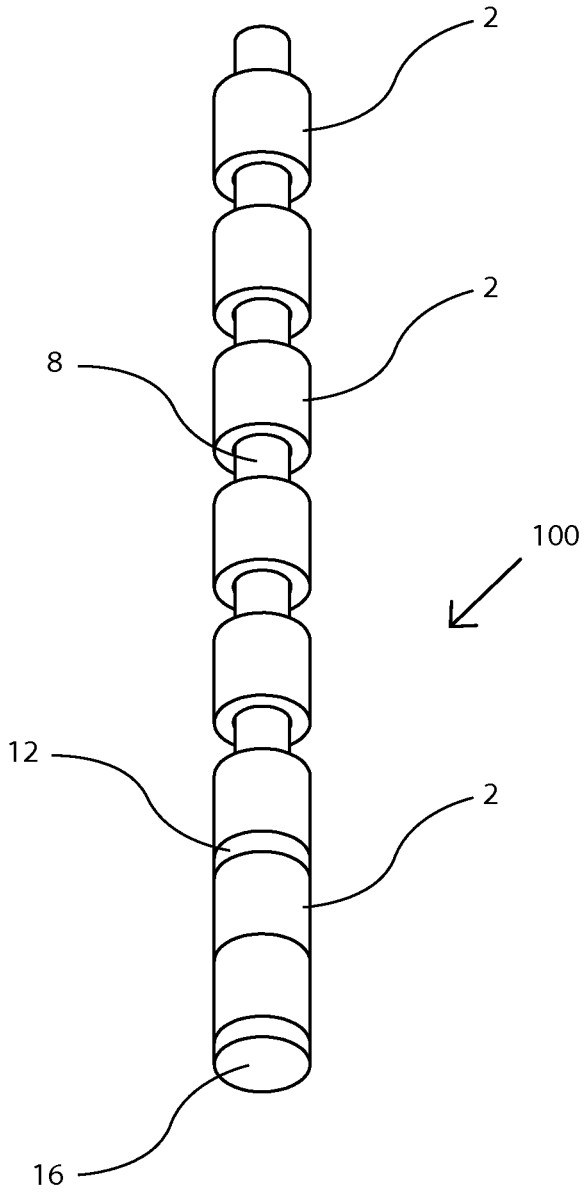
FIG. 12 is a perspective view of a further alternate embodiment of the present invention used for a hobby pursuit.

In yet another embodiment, illustrated in FIG. 12, a spring-like hobbyist arrangement is attained by placing at least two magnet segments through the elongate body 8 of the writing cartridge in a like-pole arrangement to produce a chain of repelling magnet segments 2. In this orientation, a user can apply a horizontal force in either direction to move a plurality of magnet segments of such chain in unison to produce a spring-like effect.

The combination modular magnet writing instrument and hobby tool of the present invention includes a plurality of permanent magnet segments and a writing cartridge. Each magnet segment is magnetized axially. An aperture extends longitudinally through the entirety of each magnet segment. The writing cartridge has an elongate body, which is sized for coaxial insertion within a magnet segment, or plurality of magnet segments, such that the magnet segments are in sliding engagement with the elongate body. In operation, different combinations of magnet segments can be axially positioned on the elongate body, in a variety of like-pole and unlike-pole interactions, to produce a plurality of hobby tool configurations, including writing configurations. The intended users of the tool include office workers, who may spend a significant part of their work day sitting enables such users to perform both pure functional work tasks, including writing and drawing tasks, as well as hobbyist or leisure activities, which activities may be undertaken as a form of brainstorming exercise or as a means of stress relief, or otherwise as a tool of inspiration and focus. Here, it is widely acknowledged that short bursts of leisure time in the course of a working day may serve to enhance worker productivity and beneficially impact the physical and emotional health of the worker.

The modular nature of the tool 100 and unique combination of magnetized components supports the ready disassembly and reassembly of the tool 100 into a wide variety of configurations. The example configurations illustrated in the drawings and described herein should not be construed as limiting the purposes to which the tool 100 can be applied. Indeed, the tool 100 is designed to support a range of writing, hobbyist and other pursuits. The tool 100 of the present invention can also be provided as a kit of parts, including at least a plurality of permanent magnet segments, each magnet segment having an aperture extending longitudinally therethrough and magnetized axially, and a writing cartridge having an elongate body, wherein the outside diameter of the elongate body is of a size smaller than the inside diameter of each of the plurality of magnet segments, such that the elongate body can be inserted into a magnet segment, or plurality of magnet segments in coaxial arrangement. Of course, the component parts of the tool 100 can also be manufactured and sold separately, and assembled together in a plurality of configurations, such as those described herein.

While one or more embodiments of this invention have been described above, it will be evident to those skilled in the art that changes and modifications can be made therein without departing from the essence of this invention. All such modifications are believed to be within the sphere and scope of the invention as defined by the claims appended hereto.

What is claimed is:

1. A modular magnet writing instrument and hobby tool comprising:

a magnet housing of entirely ferromagnetic material comprising a plurality of permanent magnet segments, each magnet segment haying an aperture extending longitudinally therethrough and magnetized axially, wherein the plurality of permanent magnet segments are disposed end-to-end;

a writing cartridge releasably attached to an end of the magnet housing, the writing cartridge comprising a writing member and an elongate body, wherein the outside diameter of the elongate body is sized to fit substantially within the magnet housing to provide a writing instrument arrangement; and a writing cartridge securement member comprised of a ferromagnetic material for releasably attaching the writing cartridge to the magnet housing by magnetic force.

2. The tool as defined in claim 1, wherein the writing cartridge further comprises a writing tip assembly at a first end thereof, and a writing fluid receptacle connected thereto, wherein the elongate body substantially encloses the writing fluid receptacle.

3. The tool as defined in claim 1, wherein the writing cartridge securement member fits substantially around the writing tip assembly to releasably attach the writing cartridge to a first end of the magnet housing.

4. The tool as defined in claim 1, wherein the writing cartridge is selected from the group consisting of a pen, pencil, marker, crayon, pencil-crayon or stylus.

5. The tool as defined in claim 1, further comprising a cap consisting of an at least one magnet segment having an aperture extending longitudinally therethrough, the cap for receiving a first end of the writing cartridge.

6. The tool defined in claim 5, further comprising a lid disposed at one end of the at least one magnet segment.

7. The tool defined in claim 6, wherein the lid is releasably secured to the at least one magnet segment by magnetic force.

8. The tool as defined in claim 1, wherein certain of the plurality of magnet segments of the magnet housing can be removably attached to each other and certain of the plurality of magnet segments of the magnet housing can he positioned axially around the elongate body in a plurality of configurations, to form a plurality of writing and hobby tool arrangements.

9. The tool as defined in claim 1, wherein the plurality of magnet segments of the magnet housing can be attached, detached and/or reattached in a variety of like-pole and unlike-pole combinations to facilitate the formation of a plurality of writing and hobby tool arrangements.

10. The tool as defined in claim 1, wherein the elongate body is sized for coaxial insertion within each of the plurality of magnet segments.

11. The tool as defined in claim 1, wherein the aperture of each of the plurality of magnet segments is sized for sliding engagement with the elongate body.

12. The tool defined in claim 1, wherein each of the plurality of magnet segments is of a substantially uniform shape.

13. The tool defined in claim 1, wherein each of the plurality of magnet segments is of a substantially uniform size.

14. The tool defined in claim 1, wherein each of the plurality of magnet segments is of a substantially cylindrically shaped.

15. A kit of parts for forming a combination writing instrument and hobby tool, the kit of parts comprising:

a plurality of substantially cylindrically shaped permanent magnet segments, each magnet segment having an aperture extending longitudinally therethrough and magnetized axially, where each of the plurality of magnet segments can be assembled end-to-end to form a magnet housing;

a writing cartridge for releasable attachment to an end of the magnet housing the writing cartridge comprising a writing member and an elongate body, wherein the outside diameter of the elongate body is sized to fit substantially within the magnet housing to provide a writing instrument arrangement; and a writing cartridge securement member comprised of a ferromagnetic material for releasably attaching the writing cartridge to the magnet housing by magnetic force, wherein each of the plurality of magnet segments of the magnet housing can be attached, detached and reattached in a variety of like-pole and unlike-pole combinations to facilitate the formation of a plurality of writing and hobby tool arrangements.

16. A modular magnet writing instrument and hobby tool comprising:

a magnet housing of entirely ferromagnetic material comprising a plurality of permanent magnet segments, each magnet segment having an aperture extending longitudinally therethrough and magnetized axially, wherein the plurality of permanent magnet segments are disposed end-to-end; and a writing cartridge for releasable attached to an end of the magnet housing the writing cartridge comprising a writing member and an elongate body, wherein the outside diameter of the elongate body is sized to fit substantially within the magnet housing to provide a writing instrument arrangement, wherein the magnet housing encloses the majority of the writing cartridge and wherein each of the plurality of magnet segments are in the contact with one another when mounted over the writing cartridge.

* * * * *